US011521781B2

(12) United States Patent
Inaba

(10) Patent No.: US 11,521,781 B2
(45) Date of Patent: Dec. 6, 2022

(54) REACTOR

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventor: Kazuhiro Inaba, Yokkaichi (JP)

(73) Assignees: AUTONETWORKS TECHNOLOGIES, LTD., Mie (JP); SUMITOMO WIRING SYSTEMS, LIMITED, Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 415 days.

(21) Appl. No.: 16/763,187

(22) PCT Filed: Nov. 6, 2018

(86) PCT No.: PCT/JP2018/041172
§ 371 (c)(1),
(2) Date: May 11, 2020

(87) PCT Pub. No.: WO2019/102842
PCT Pub. Date: May 31, 2019

(65) Prior Publication Data

US 2020/0395161 A1 Dec. 17, 2020

(30) Foreign Application Priority Data

Nov. 21, 2017 (JP) ..... JP2017-223947

(51) Int. Cl.
*H01F 27/24* (2006.01)
*H01F 1/20* (2006.01)
(Continued)

(52) U.S. Cl.
CPC ..... *H01F 27/24* (2013.01); *H01F 1/20* (2013.01); *H01F 27/022* (2013.01); *H01F 27/324* (2013.01)

(58) Field of Classification Search
CPC ..... H01F 1/20; H01F 27/022; H01F 27/24; H01F 27/324
See application file for complete search history.

(56) References Cited

U.S. PATENT DOCUMENTS 8,279,035 B2 * 10/2012 Yoshikawa ..... H01F 27/06 336/96
8,416,046 B2 * 4/2013 Yoshikawa ..... H01F 37/00 336/180

(Continued)

FOREIGN PATENT DOCUMENTS

JP 2009-033055 A * 2/2009
JP 2009-033057 A * 2/2009

(Continued)

OTHER PUBLICATIONS

Dec. 18, 2018 International Search Report issued in International Patent Application No. PCT/JP2018/041172.

*Primary Examiner* — Carl J Arbes
(74) *Attorney, Agent, or Firm* — Oliff PLC

(57) ABSTRACT

A reactor including: a coil having a winding portion; a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion.

8 Claims, 4 Drawing Sheets

(51) Int. Cl.
*H01F 27/02* (2006.01)
*H01F 27/32* (2006.01)

(56) References Cited

U.S. PATENT DOCUMENTS

| | | | |
|---|---|---|---|
| 2012/0154093 | A1 | 6/2012 | Yoshikawa et al. |
| 2019/0259532 | A1 | 8/2019 | Hirabayashi et al. |

FOREIGN PATENT DOCUMENTS

| | | | | |
|---|---|---|---|---|
| JP | 2011-142193 | A | * | 7/2011 |
| JP | 2011-253982 | A | | 12/2011 |
| JP | 4946775 | B | * | 6/2012 |
| JP | 5050745 | B | * | 10/2012 |
| JP | 5341306 | B | * | 11/2013 |
| JP | 2014-120743 | A | | 6/2014 |

* cited by examiner

REACTOR

BACKGROUND

The present disclosure relates to a reactor.

This application is based upon and claims the benefit of priority from Japanese Patent Application No. 2017-223947 filed Nov. 21, 2017, the entire content of which is hereby incorporated by reference.

As a reactor for use in an in-vehicle converter or the like, JP 2017-135334A discloses a reactor that includes a coil having a pair of winding portions, a magnetic core, and a resin molded portion that covers the outer peripheral faces of the magnetic core and exposes the coil and does not cover it. The magnetic core includes multiple inner core pieces that are disposed inside the winding portions, and two outer core pieces that are disposed outside the winding portions. These core pieces are combined into a ring shape.

SUMMARY

A reactor according to an aspect of the present disclosure includes: a coil having a winding portion; a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion, wherein the magnetic core includes an inner core piece disposed inside the winding portion, and an outer core piece that is exposed from the winding portion, the outer core piece includes a small area portion having a connecting face that is connected to an end face of the inner core piece and has a smaller area than the end face, and a large area portion having a magnetic path sectional area that is larger than the area of the end face of the inner core piece, in a view in an axial direction of the winding portion from an outer end face of the outer core piece in a state where the outer core piece has been combined with the inner core piece, the end face of the inner core piece has an overlapping region that is overlapped with the small area portion, and a non-overlapping region that is not overlapped with both the small area portion and the large area portion, and the resin mold includes an end face covering that covers the nonoverlapping region.

DETAILED DESCRIPTION OF EMBODIMENTS

Figure 1:
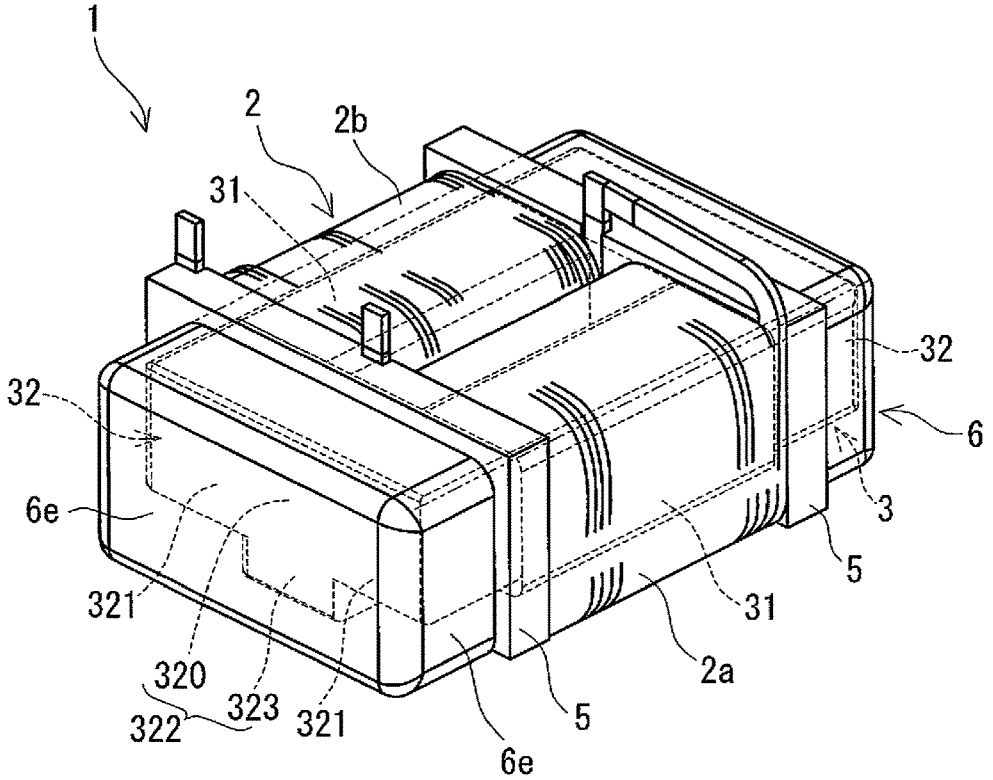
FIG. 1 is a schematic perspective view of a reactor according to a first embodiment.

There has been desire for a reactor that has excellent heat dissipation performance and enables a resin molded portion to be formed easily.

The outer core pieces disclosed in JP 2017-135334A are each a columnar body provided with inner end faces that are for connection to the end faces of inner core pieces and are uniform flat faces, and the lower faces of the outer core piece protrude downward beyond the lower faces of the inner core pieces. When compared with the case where the upper and lower faces of the outer core pieces are flush with the upper and lower faces of the inner core pieces, the aforementioned outer core pieces have a larger surface due to the protruding portions, and have excellent heat dissipation performance. However, due to the provision of the protruding portions, it is difficult to form the resin molded portion that covers the outer peripheral faces of the magnetic core while exposing the coil. This is because flow-state resin, which is the raw material for forming the resin molded portion (hereinafter, also called the mold raw material), cannot easily be introduced into the tube-shaped gap between the winding portion and the inner core pieces (hereinafter, also called the tubular gap).

Specifically, when the inner core piece is combined with the outer core piece that has the protruding portion, the outer core piece is disposed so as to block at least a portion of openings formed by the inner peripheral edge of the winding portion and the peripheral edge of the end face of the inner core piece. The right half of FIG. 4 in JP 2017-135334A is a view along the axial direction of the winding portion. In a view of the interior of the winding portion in this diagram, four openings are formed around the inner core piece. However, in a view from the outer end face of the outer core piece when the outer core piece has been combined with the inner core piece, two openings on the inner side and the lower side are covered and blocked by the outer core piece. The aforementioned four openings are openings that the inner peripheral edge of the winding portion forms with the upper edge, the lower edge, the outward edge, and the inward edge of the square end face of the inner core piece. When the mold raw material is poured from the outer end face side of the outer core piece toward the inner core piece, the mold raw material can be introduced into the aforementioned tubular gap through the outward opening and the upper opening that are not covered by the outer core piece. However, it is difficult to introduce the mold raw material through the inward opening and the lower opening that are covered by the outer core piece. Particularly in the case where the tubular gap is reduced in size in order to obtain a smaller reactor, it is even more difficult to fill the gap with the mold raw material. Accordingly, there is desire for a configuration that makes it easier to fill the tubular gap with the mold raw material.

In view of this, an exemplary aspect of the disclosure provides a reactor that has excellent heat dissipation performance and enables the resin molded portion to be formed easily.

A reactor according to the present disclosure has excellent heat dissipation performance and enables the resin molded portion to be formed easily.

DESCRIPTION OF EMBODIMENTS OF THE DISCLOSURE

First, embodiments of the present disclosure will be listed and described.

(1) A reactor according to one aspect of the present disclosure includes:

a coil having a winding portion;

a magnetic core that is disposed extending inside and outside the winding portion, and is configured to form a closed magnetic circuit; and a resin molded portion that includes an inner resin portion disposed between the winding portion and the magnetic core, and does not cover an outer peripheral face of the winding portion, wherein the magnetic core includes an inner core piece disposed inside the winding portion, and an outer core piece that is exposed from the winding portion, the outer core piece includes a small area portion having a connecting face that is connected to an end face of the inner core piece and has a smaller area than the end face, and a large area portion having a magnetic path sectional area that is larger than the area of the end face of the inner core piece, in a view in an axial direction of the winding portion from an outer end face of the outer core piece in a state where the outer core piece has been combined with the inner core piece, the end face of the inner core piece has an overlapping region that is overlapped with the small area portion, and a nonoverlapping region that is not overlapped with both the small area portion and the large area portion, and the resin molded portion includes an end face covering portion that covers the nonoverlapping region.

The above-described reactor of the present disclosure includes the resin molded portion that covers at least one portion of the inner core piece in a state of exposing the winding portion. For this reason, the insulation performance between the winding portion and the inner core piece is improved by the inner resin portion. Also, in the case where the reactor is cooled by a cooling medium such as a liquid coolant, the winding portion is brought into direct contact with the cooling medium, thus achieving excellent heat dissipation performance. Furthermore, the outer core piece provided in the above-described reactor of the present disclosure has an uneven shape due to the fact that the magnetic path area of the small area portion (the area of the connecting face) and the magnetic path area (magnetic path sectional area) of the large area portion are different from each other. For this reason, compared to the case where the entirety of the outer core piece has a uniform magnetic path area (corresponding to the area of the connecting face), heat is more easily dissipated from the large area portion, and the large area portion more easily comes into contact with the aforementioned cooling medium. Accordingly, the above-described reactor of the present disclosure has even more excellent heat dissipation performance. If the surface area is higher due to the provision of the large area portion, the heat dissipation performance is even more excellent.

In particular, in the above-described reactor of the present disclosure, the outer core piece has an uneven shape as described above, and includes the portion (a portion of the large area portion) that protrudes beyond an outer peripheral face of the inner core piece. This protruding portion is disposed at a position not covering the end face of the inner core piece. Also, the small area portion is disposed at a position covering the end face of the inner core piece. Moreover, the size of the small area portion is set so as to not cover a portion of the end face of the inner core piece. For the following reasons, the above-described reactor of the present disclosure enables a tubular gap between the winding portion and the inner core piece to be easily filled with a mold raw material, thus enabling the resin molded portion to be formed easily.

Before formation of the resin molded portion, when the assembled magnetic core is viewed in the axial direction of the winding portion from the outer end face of the outer core piece (here, this corresponds to a front view), the nonoverlapping region of the end face of the inner core piece is exposed from the outer core piece. As a result, an opening formed by a peripheral edge of the nonoverlapping region and an inner peripheral edge of the winding portion is exposed from the outer core piece. Accordingly, it is possible to ensure that a portion of the opening formed by the inner peripheral edge of the winding portion and the peripheral edge of the end face of the inner core piece is not covered by the outer core piece. For this reason, when the mold raw material is to be supplied from the outer end face side of the outer core piece toward the inner core piece, the mold raw material can be introduced through the opening that is exposed from the outer core piece. Furthermore, the mold raw material can be introduced into the tubular gap through the aforementioned opening.

Furthermore, with the above-described reactor of the present disclosure, the weight of the outer core piece can be made lower than in the case where the outer core piece has the magnetic path sectional area of the large area portion over the entire length thereof. A reduction in weight can therefore be achieved.

(2) In an example of the reactor according to the present disclosure, a relative permeability of the outer core piece is higher than a relative permeability of the inner core piece.

In this aspect, even when the connecting face of the outer core piece is smaller than the end face of the inner core piece, flux leakage between the outer core piece and the inner core piece can be reduced. The above aspect therefore enables reducing loss attributed to flux leakage.

(3) In an example of the reactor according to the present disclosure, the inner core piece is constituted by a compact made of a composite material that includes a magnetic powder and a resin.

The relative permeability of the composite material compact is easily reduced if the filling rate of the magnetic powder is lowered. If the relative permeability of the inner core piece is smaller than the relative permeability of the outer core piece, it is possible to reduce flux leakage between the two core pieces as described above. Also, if the relative permeability of the inner core piece is reduced to a certain extent (see later-described section (5)), it is possible to obtain a magnetic core that has no magnetic gaps. The gapless-structure magnetic core has substantially no flux leakage that is attributed to a magnetic gap. For this reason, the above-described tubular gap can be made even smaller. Therefore, according to the above aspect, it is possible to further reduce loss corresponding to flux leakage that occurs between the core pieces and flux leakage attributed to a magnetic gap, and it is possible to further reduce the size of the reactor due to the tubular gap being small. Even if the tubular gap is small, the mold raw material can be easily introduced into the tubular gap through the opening that is exposed from the outer core piece as described above, and the resin molded portion can be formed easily.

(4) In an example of the reactor according to section (3) above, the area of the connecting face of the outer core piece is greater than or equal to a value obtained by multiplying the area of the end face of the inner core piece by a filling rate of the magnetic powder in the inner core piece.

In the above aspect, the product value can be called the effective magnetic path area of the inner core piece. For this reason, the area of the connecting face of the outer core piece is greater than or equal to the effective magnetic path area of the inner core piece. The above aspect therefore makes it possible to more reliably reduce flux leakage between the inner core piece and the outer core piece.

(5) In an example of the reactor according to the present disclosure, a relative permeability of the inner core piece is in a range of 5 to 50 inclusive, and a relative permeability of the outer core piece is a factor of 2 times or more the relative permeability of the inner core piece.

In the above aspect, the relative permeability of the outer core piece is higher than the relative permeability of the inner core piece, and the difference between the two relative permeabilities is large. For this reason, as described in section (2) above, it is possible to more reliably reduce flux leakage between the core pieces. Due to this difference, flux leakage can be substantially eliminated. Also, according to the above aspect, the relative permeability of the inner core piece is low, thus making it possible to obtain a gapless-structure magnetic core. Accordingly, with the above aspect, it is possible to further reduce loss attributed to flux leakage as described in section (3) above and to achieve a further size reduction, while also enabling the resin molded portion to be formed easily.

(6) In an example of the reactor according to section (5) above, the relative permeability of the outer core piece is in a range of 50 to 500 inclusive.

In the above aspect, the relative permeability of the outer core piece satisfies not only section (5) above but also the specific range described above, and thus making it possible to easily increase the difference between the relative permeability of the outer core piece and the relative permeability of the inner core piece. If the difference is large (e.g., greater than or equal to 100), it is also possible to reduce flux leakage between the core pieces even if the size of the small area portion of the outer core piece is reduced. Also, if the size of the small area portion of the outer core piece is reduced, the size of the nonoverlapping region of the inner core piece increases. For this reason, the size of the above-described opening exposed from the outer core piece also increases, and the resin molded portion can be formed more easily.

(7) In an example of the reactor according to section (6) above, the outer core piece is constituted by a powder compact.

In the case where the outer core piece is a powder compact, the outer core piece having the above-described uneven shape can be molded easily and precisely. For this reason, it is possible to precisely obtain an outer core piece whose relative permeability satisfies the range in section (5) above. The above aspect therefore is excellent in terms of the manufacturability of the outer core piece.

(8) In an example of the reactor according to the present disclosure, the coil has a pair of the winding portions that are disposed so as to be laterally adjacent to each other and have parallel axes, the magnetic core has a pair of the inner core pieces that are laterally adjacent to each other and are disposed inside the winding portions, and for each of the inner core pieces, in a case where the end face of the inner core piece is equally divided into two regions in a direction in which the pair of inner core pieces are laterally adjacent to each other, the overlapping region of the inner core piece includes 50% or more of the region on the side closer to the adjacent inner core piece.

When the region of the end face of the inner core piece that is closer to the adjacent inner core piece (hereinafter, sometimes called the inward region) is compared with the region that is distant from the adjacent inner core piece (hereinafter, sometimes called the outward region), magnetic flux more easily flows through the inward region. In the above aspect, the overlapping region includes a larger percentage of the inward region. This therefore makes it possible to reduce flux leakage between the inner core piece and the outer core piece.

DETAILS OF EMBODIMENTS OF THE DISCLOSURE

Hereinafter, embodiments of the present disclosure will be described in detail with reference to the drawings. In the drawings, like reference numerals denote objects having like names.

First Embodiment

The following describes a reactor 1 according to a first embodiment with reference to FIGS. 1 to 7.

In the following description, the installation side of the reactor 1 that comes into contact with the installation target is called the lower side, and the side opposite thereto is called the upper side. The drawings illustrate the case where the lower side is the installation side of the reactor 1.

1. Overview

Figure 2:
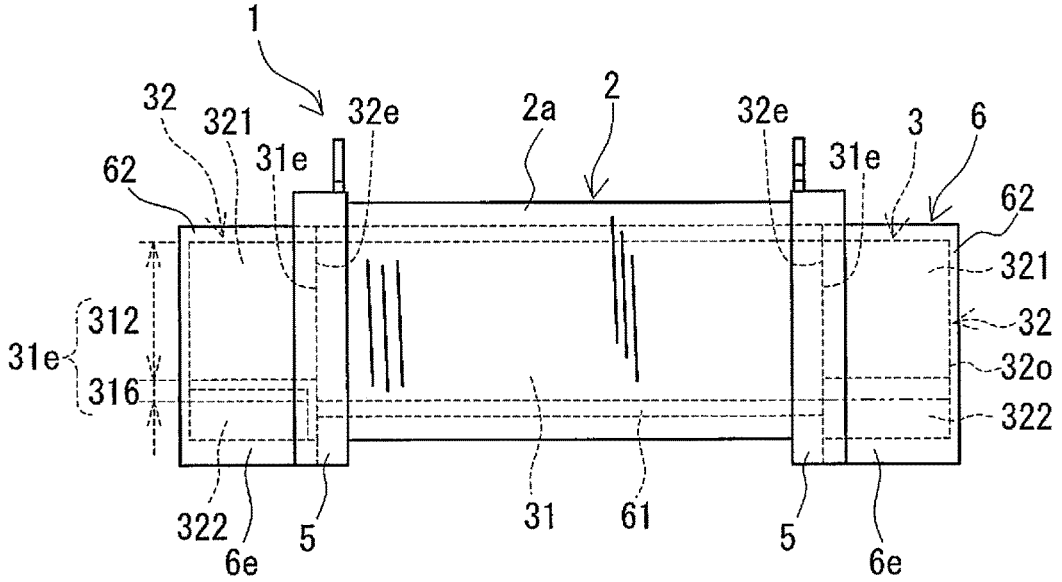
FIG. 2 is a schematic side view of the reactor according to the first embodiment.

As shown in FIG. 1, the reactor 1 of the first embodiment includes a coil 2, a magnetic core 3 that forms a closed magnetic circuit, and a resin molded portion 6 (resin mold). In this example, the coil 2 includes a pair of winding portions 2*a* and 2*b*. The winding portions 2*a* and 2*b* are disposed laterally adjacent to each other with parallel axes. The magnetic core 3 includes a pair of inner core pieces 31 that are laterally adjacent to each other and respectively disposed in the winding portions 2*a* and 2*b*, and two outer core pieces 32 that are exposed from the winding portions 2*a* and 2*b*. The resin molded portion 6 includes two inner resin portions 61 (inner resins) that are respectively arranged between the winding portions 2*a* and 2*b* and the magnetic core 3 (here, the two inner core pieces 31) as shown in FIG. 2. The resin molded portion 6 exposes the outer peripheral faces of the winding portions 2*a* and 2*b* and does not cover them. The magnetic core 3, which extends inside and outside the winding portions 2*a* and 2*b*, is assembled into a ring shape by disposing the two outer core pieces 32 so as to sandwich the two inner core pieces 31 that are laterally adjacent and extend along the winding portions 2*a* and 2*b*. This type of reactor 1 is typically used in a state of being attached to an installation target such as a converter case (not shown).

In particular, the outer core pieces 32 provided in the reactor 1 of the first embodiment each include small area portions 321 and a large area portion 322 that have different magnetic path areas. As shown in FIG. 3B, the small area portions 321 each include a connecting face 321*e* for connection with an end face 31*e* of one inner core piece 31. The connecting face 321*e* has an area $S_{32}$ that is smaller than an area $S_{31}$ of the end face 31*e* of the inner core piece 31. The large area portion 322 is disposed at a position shifted away from the end face 31*e* of the inner core pieces 31. Also, the large area portion 322 has a magnetic path sectional area $S_{322}$ that is larger than the area $S_{31}$ of the end face 31*e*. The areas $S_{32}$ and $S_{322}$ both correspond to magnetic path areas.

Figure 4:
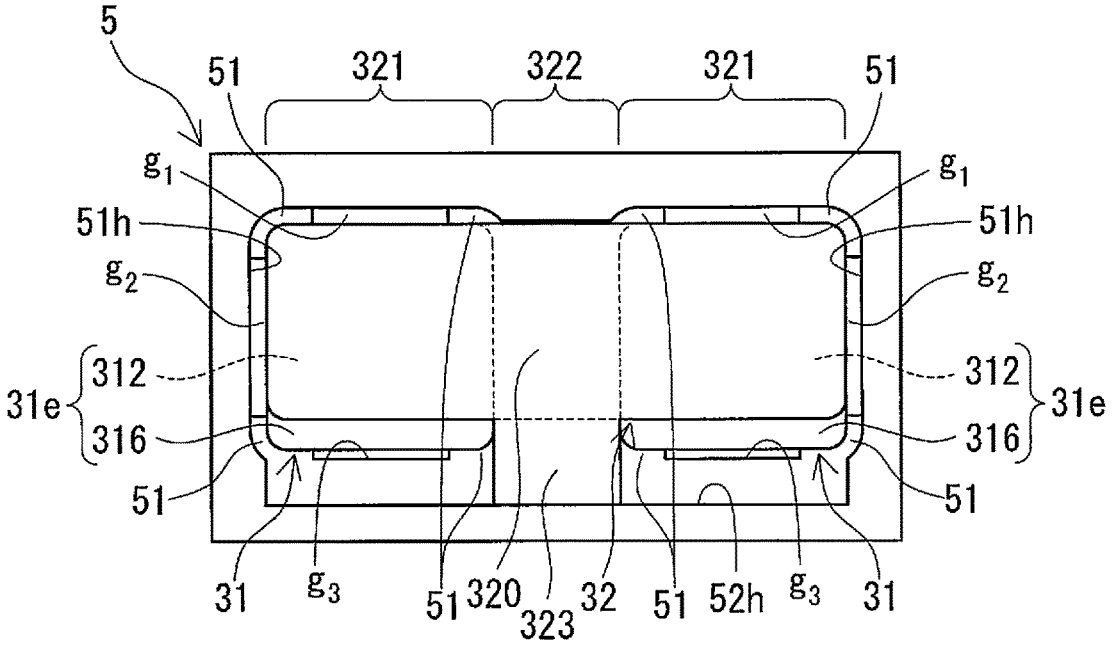
FIG. 4 is a front view of a state where inner core pieces, outer core pieces, and intermediate members have been combined in the reactor according to the first embodiment.

In the state where the magnetic core 3 provided with the outer core pieces 32 is combined with the coil 2 (hereinafter, this state will sometimes be called the assembled state), when the end face 31*e* of each of the inner core pieces 31 is viewed along the axial direction of the winding portions 2*a* and 2*b* from an outer end face 32*o* of one of the outer core pieces 32, a portion of the end face 31*e* (overlapping region 312) is covered by the corresponding small area portion 321. However, the remaining portion of the end face 31*e* (nonoverlapping region 316) is not covered by both the small area portion 321 and the large area portion 322 (see FIG. 4 as well). Also, an opening $g_3$ formed by the inner peripheral edge of the winding portion 2*a* (or the winding portion 2*b*) and the peripheral edge of the nonoverlapping region 316 is also not covered by both the small area portion 321 and the large area portion 322 (FIG. 4). For this reason, when forming the resin molded portion 6 that covers the magnetic core 3 while also exposing the coil 2 in the process of manufacturing the reactor 1, the mold raw material can be introduced through not only openings $g_1$ and $g_2$ (shown in FIG. 4 and described later) but also the opening $g_3$. Also, the mold raw material can be introduced into the tubular gap between the winding portion 2*a* (or the winding portion 2*b*) and the inner core piece 31 through the openings $g_1$ to $g_3$. For this reason, the resin molded portion 6 can be formed easily.

Hereinafter, the constituent elements will each be described in detail.

2. Coil

The coil 2 in this example includes the tube-shaped winding portions 2*a* and 2*b*, which are formed by winding a winding wire into a spiral shape. The following are aspects of the coil 2 that includes the pair of laterally adjacent winding portions 2*a* and 2*b*.

(α) The coil 2 includes the winding portions 2*a* and 2*b* that are formed by a single continuous winding wire, and a coupling portion that couples the winding portions 2*a* and 2*b*. The coupling portion is constituted by a portion of the winding wire that spans the winding portions 2*a* and 2*b*.

(ß) The coil 2 includes the winding portions 2*a* and 2*b* that are formed by two independent winding wires, and the following joining portion (illustrated in FIG. 1). The joining portion is obtained by performing welding, pressure bonding, or the like on the end portions on one side of the winding wires that have been drawn out from the winding portions 2*a* and 2*b*.

In both of the above aspects, the end portions (other end portions in aspect ß) of the winding wires drawn out from the winding portions 2*a* and 2*b* are used as connections for connection to an external apparatus such as a power supply.

One example of the winding wire is a coated wire that includes a conductor wire made of copper or the like, and an insulating coating that is made of a polyamide imide resin or the like and surrounds the conductor wire. The winding portions 2*a* and 2*b* in this example are each a quadrangular tube-shaped edgewise coil in which the winding wire, which is constituted by a coated rectangular wire, is wound edgewise. Also, the winding portions 2*a* and 2*b* have the same specifications in terms of shape, winding direction, and number of turns, for example. The shape, size, and the like of the winding wires and the winding portions 2*a* and 2*b* can be selected as desired. For example, the winding wires may be coated round wires, and the winding portions 2*a* and 2*b* may be shaped as a tube that does not have corner portions, such as a circular tube, an elliptical tube, or a racetrack shape. Also, the winding portions 2*a* and 2*b* may have different specifications from each other.

In the reactor 1 of the first embodiment, the outer peripheral faces of the winding portions 2*a* and 2*b* are completely exposed and not covered by the resin molded portion 6. On the other hand, the inner resin portions 61, which are part of the resin molded portion 6, are disposed inside the winding portions 2*a* and 2*b*. For this reason, the inner peripheral faces of the winding portions 2*a* and 2*b* are covered by the resin molded portion 6.

3. Magnetic Core 3.1 Overview

The outer peripheral faces of the magnetic core 3 in this example are covered by the resin molded portion 6 in the state where the two inner core pieces 31 and the two outer core pieces 32 described above have been combined to form a ring shape. The magnetic core 3 is held in the integrated state by the resin molded portion 6. Also, the magnetic core 3 in this example has a gapless structure in which substantially no magnetic gap exists between the core pieces.

In the reactor 1 of the first embodiment, the magnetic path area (magnetic path sectional area) of the outer core piece 32 is different in portions rather than being uniform over the entire length. As shown in FIG. 3B, the outer core pieces 32 each include the small area portions 321 that have the magnetic path area $S_{32}$, and the large area portion 322 that has the magnetic path sectional area $S_{322}$ that is larger than the magnetic path area $S_{32}$. The small area portions 321 and the large area portion 322 are formed as a single piece, and the outer core piece 32 has a step-like shape. The small area portions 321 each have the connecting face 321*e* for connection with an inner core piece 31. The small area portions 321 in this example are aligned coaxially with the inner core pieces 31. The large area portion 322 is not connected to the inner core pieces 31. The large area portion 322 in this example is disposed so as to span between two laterally adjacent inner core pieces 31 and so as to not be overlapped with both of the inner core pieces 31 (see FIG. 4 as well).

The connecting face 321*e* of each of the small area portions 321 has the magnetic path area $S_{32}$. Also, the area of the connecting face 321*e* is smaller than the area $S_{31}$ of the end face 31*e* of the inner core piece 31. For this reason, a portion of the end face 31*e* of the inner core piece 31 can be a region that is not overlapped with the outer core piece 32 in the assembled state, that is to say the nonoverlapping region 316 (see FIG. 4). The region including the nonoverlapping region 316 that is not overlapped with the outer core piece 32 is used as a location for introduction of the mold raw material when forming the resin molded portion 6.

Figure 3A:
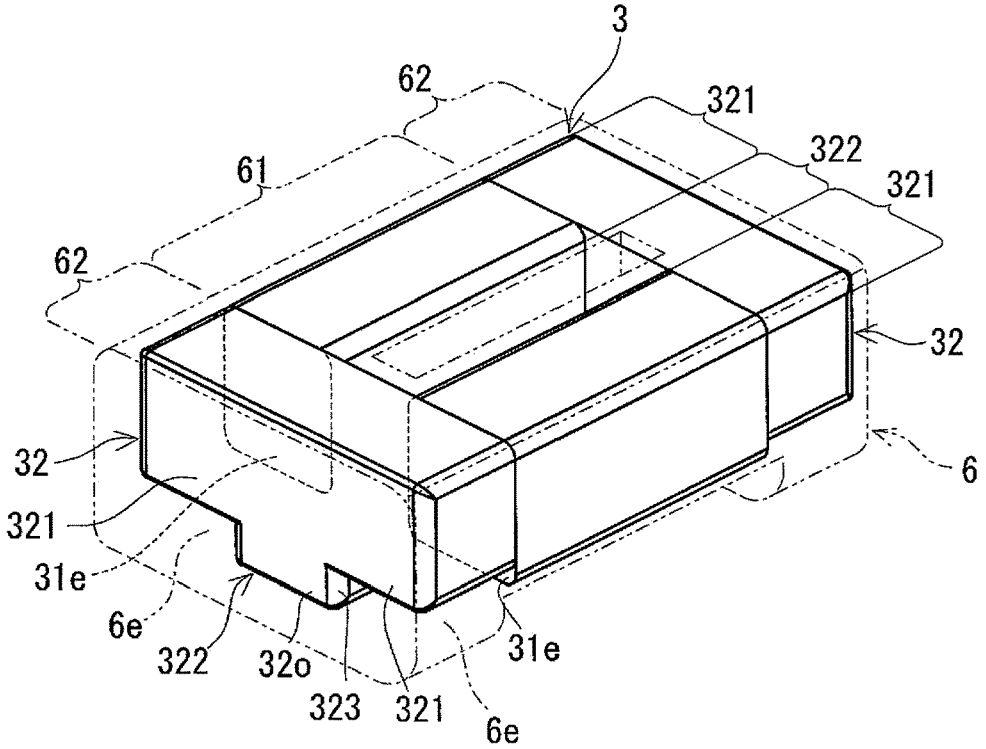
FIG. 3A is a schematic perspective view of a magnetic core provided in the reactor according to the first embodiment.
Figure 3B:
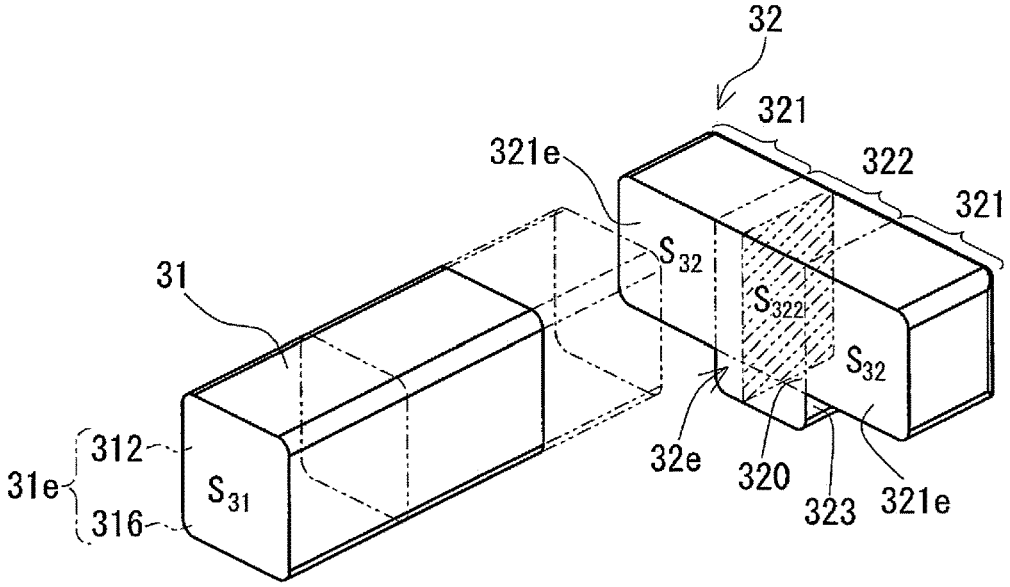
FIG. 3B is an exploded perspective view of an inner core piece and an outer core piece in the magnetic core provided in the reactor according to the first embodiment.

The following describes the inner core pieces 31 and the outer core pieces 32 in this order, mainly with reference to FIGS. 3A and 3B.

FIG. 3A is a perspective view of the magnetic core 3 in the assembled state. In FIG. 3A, the resin molded portion 6 that covers the outer peripheral faces of the magnetic core 3 is shown virtually using dashed double-dotted lines. Also, FIG. 3B is a perspective view showing one inner core piece 31 and one outer core piece 32 in the disassembled state.

FIG. 3B illustrates the state where the inner core piece 31, which is virtually shown using dashed double-dotted lines, is being moved toward the outer core piece 32.

3.2 Inner Core Piece

In this example, the portion of the magnetic core 3 that is disposed inside the winding portion 2*a* and the portion of the magnetic core 3 that is disposed inside the winding portion 2*b* are both mainly constituted by one columnar inner core piece 31. The two end faces 31*e* and 31*e* of the inner core piece 31 are respectively joined to the connecting faces 321*e* of two outer core pieces 32 (see FIG. 2 as well). Note that in this example, later-described intermediate members 5 are disposed at the joints between the inner core piece 31 and the outer core pieces 32.

The two inner core pieces 31 in this example have the same shape and the same size. Each of the inner core pieces 31 has a cuboid shape as shown in FIG. 3B. Also, the inner core piece 31 has a uniform magnetic path sectional area $S_{31}$ (the same as the area $S_{31}$ of the end face 31*e*) over the entire length thereof. The shape of the inner core piece 31 can be changed as desired. For example, the inner core piece 31 may be shaped as a circular column, or a polygonal column such as a hexagonal column. In the case of being shaped as a polygonal column, the corner portions may be subjected to C chamfering or R chamfering as shown in FIG. 3B. Rounding the corner portions not only suppresses chipping and achieves excellent strength, but also makes it possible to reduce the weight and increase the area of contact with the inner resin portion 61. The magnetic path sectional area $S_{31}$ (area $S_{31}$) can be appropriately selected so as to obtain a predetermined magnetic characteristic.

3.3 Outer Core Piece

In this example, the portion of the magnetic core 3 that is disposed outside the winding portion 2*a* and the portion of the magnetic core 3 that is disposed outside the winding portion 2*b* are both mainly constituted by one columnar outer core piece 32.

The two outer core pieces 32 in this example have the same shape and the same size. As shown in FIGS. 3A and 3B, each of the outer core pieces 32 is shaped as a columnar body in which the outer end face 32*o* and the inner end face 32*e* are T-shaped. Specifically, the outer core piece 32 has a cuboid base portion 320, the two cuboid small area portions 321, and a cuboid projection portion 323. The two small area portions 321 respectively project leftward and rightward on opposite sides of the base portion 320. The projection portion 323 projects downward from the base portion 320. The large area portion 322 is constituted by the base portion 320 and the projection portion 323. The upper faces of the base portion 320 and the two small area portion 321 (the surfaces opposite to the installation face) are substantially flush with each other. The faces of the base portion 320, the two small area portions 321, and the projection portion 323 that face the winding portions 2*a* and 2*b* form the T-shaped inward end face 32*e*, and the faces thereof on the opposite side form the T-shaped outer end face 32*o*. The inward end face 32*e* and the outer end face 32*o* are substantially flush with each other and have the same size. Note that the boundaries between the large area portion 322 and the small area portions 321 in the outer core piece 32 on the right side in FIGS. 2 and 3B is shown virtually using dashed double-dotted lines.

The regions of the small area portions 321 that form part of the inner end face 32*e* are the two connecting faces 321*e* for connection to the end faces 31*e* of the two inner core pieces 31. In each of the small area portions 321, the connecting face 321*e* for connection to the corresponding inner core piece 31 and the connecting face for connection to the large area portion 322 (here, one face of the base portion 320) both have the area $S_{32}$. This area $S_{32}$ is smaller than the area $S_{31}$ of the end face 31*e* of the inner core piece 31 ($S_{32}<S_{31}$).

The large area portion 322 is arranged between the two small area portions 321 and has the magnetic path sectional area $S_{322}$. The large area portion 322 includes the projection portion 323 in addition to the base portion 320 that has the area $S_{32}$. For this reason, the magnetic path sectional area $S_{322}$ is larger than the area $S_{32}$ ($S_{32}<S_{323}$). Also, the magnetic path sectional area $S_{322}$ is larger than the area $S_{31}$ of the end face 31*e* of the inner core piece 31 ($S_{31}<S_{322}$). In other words, the magnetic core 3 satisfies the relationship $S_{32}<S_{31}<S_{322}$ in terms of area. Note that the magnetic path sectional area $S_{322}$ of the large area portion 322 is the sectional area when cut at a plane that is orthogonal to the direction in which the two inner core pieces 31 are laterally adjacent.

3.4 Assembled State

As shown in the front view of the magnetic core 3 in the assembled state in FIG. 4, the outer core piece 32 has portions that are recessed from edges of the outer peripheral faces of the two inner core pieces 31, as well as a portion that protrudes beyond the outer peripheral faces of the two inner core pieces 31. These recessed portions are the two small area portions 321. The small area portions 321 are disposed so as to cover a portion of the end faces 31*e* of the two inner core pieces 31, and not cover the remaining portion. The aforementioned protruding portion is the projection portion 323. The projection portion 323 is disposed so as to not be overlapped with the end faces 31*e*. When the outer core piece 32 is combined with the inner core pieces 31, the end face 31*e* of each of the inner core pieces 31 has a region that is overlapped with the corresponding small area portion 321 (i.e., the overlapping region 312), and the nonoverlapping region 316 that is not overlapped with both the small area portion 321 and the large area portion 322.

In the magnetic core 3 before the formation of the resin molded portion 6, the nonoverlapping regions 316 of the two inner core pieces 31 are exposed and not covered by the outer core piece 32. As a result, the openings $g_3$ formed by the peripheral edges of the nonoverlapping regions 316 and the inner peripheral edges of the winding portions 2*a* and 2*b* are also exposed to the outside of the outer core piece 32. These openings $g_3$ can be used as openings for the introduction of the mold raw material to the above-described tubular gaps. For this reason, the portions of the magnetic core 3 that form the introduction openings (the opening $g_3$ and the later-described openings $g_1$ and $g_2$) can be said to be bigger than in the case of a magnetic core in which the front of the openings $g_3$ is covered by the outer core piece (hereinafter, also called a conventional core).

When the magnetic core 3 in this example is viewed from one lateral side in the assembled state as shown in FIG. 2, the lower faces of the small area portions 321 (here, the faces on the side closer to the installation target; the same follows hereinafter) are located above (on the side distant from the installation target) the lower faces of the two inner core pieces 31. Also, the lower faces of the large area portions 322 (projection portions 323) are located below (on the side closer to the installation target) the lower faces of the two inner core pieces 31. For this reason, the nonoverlapping regions 316 in this example form regions below the end faces 31*e* of the inner core pieces 31. The openings $g_3$ are formed by the lower edges of the two end faces 31*e* and the inner peripheral edges of the winding portions 2*a* and 2*b*.

Figure 5:
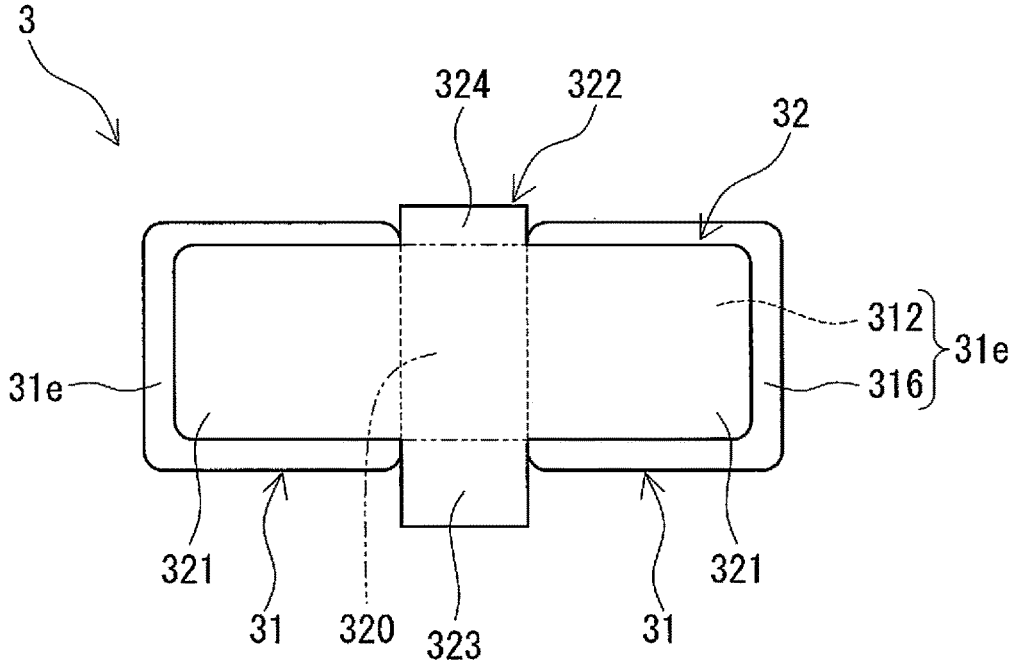
FIG. 5 is a front view of another example of an outer core piece provided in the reactor according to the first embodiment.

Although the nonoverlapping region 316 in this example has a rectangular shape, the shape can be changed as desired. The shape of the nonoverlapping region 316 can be easily changed by changing the shape and size of the small area portion 321 of the outer core piece 32. For example, a configuration is possible in which the small area portion 321 has a smaller rectangular shape than in FIG. 4 in a front view, and the nonoverlapping region 316 is shaped as an "L" that includes the lower edge and the outer edge of the end face 31*e* of the inner core piece 31, or is shaped as a "]" that includes the upper edge, the outward edge, and the lower edge of the end face 31*e*. FIG. 5 shows an example in which the nonoverlapping region 316 is shaped as a "]". If the nonoverlapping region 316 is shaped as an "L" or a "]", it is possible to reduce the size of the small area portions 321 of the outer core pieces 32 and thus achieve a weight reduction. Also, a space corresponding to the height difference between the end faces 31*e* and the small area portions 321 is provided in the vicinity of the openings $g_1$ and $g_2$. This space is relatively large, and therefore makes it easier to pour the mold raw material. For this reason, the mold raw material can also be easily introduced into the openings $g_1$ and $g_2$ through this space. Furthermore, the portion of the resin molded portion 6 that is formed by the filling of this space is likely to be thicker than the portions that cover the outer peripheral faces of the inner core pieces 31. This thick portion is provided at the location where the inner core pieces 31 and the outer core pieces 32 are connected to each other, thus achieving excellent connection strength between the inner core pieces 31 and the outer core pieces 32.

It is preferable that each of the overlapping regions 312 that are covered by the outer core piece 32 includes a large portion of an inward region that is described below. In particular, it is further preferable that the overlapping region 312 includes 50% or more of the inward region as in this example. Here, in the case where the region making up the end face 31*e* of the inner core piece 31 is equally divided into two regions in the direction in which the pair of inner core pieces 31 are laterally adjacent to each other, the inward region of the end face 31*e* of the inner core piece 31 is the region that includes the inward edge that is close to the adjacent inner core piece 31. Also, the region that includes the outward edge that is distant from the adjacent inner core piece 31 is the outward region. Magnetic flux passes more easily through the inward region of the end face 31*e* than the outward region. For this reason, if the overlapping region 312 includes 50% or more of the inward region, it is easy to reduce the amount of flux leakage between the inner core piece 31 and the outer core piece 32. If the overlapping region 312 includes 60% or more of the inward region, or furthermore 70% or more, it is even easier to reduce such flux leakage. The overlapping region 312 can include 100% or less of the inward region. The larger the percentage of the inward region that the overlapping region 312 includes is, the larger the overlapping region 312 is likely to be. In other words, the small area portions 321 of the outer core piece 32 are likely to be larger, which is likely to invite an increase in weight. If there is a desire for further weight reduction for example, the overlapping region 312 can include less than or equal to 98%, or furthermore less than or equal to 95% or less than or equal to 90% the inward region. The percentage of the inward region that the end face 31*e* includes can be set differently between the two inner core pieces 31. Note that it is preferable that both of the inner core pieces 31 include 50% or more of the inward region, and it is further preferable that the percentages are the same as in this example.

3.5 Areas

The areas $S_{31}$, $S_{32}$, and $S_{322}$ can be selected according to the constituent material of the inner core pieces 31 and the outer core pieces 32 (described later), within a range according to which the magnetic core 3 has a predetermined inductance, and furthermore the relationship $S_{32}<S_{31}<S_{322}$ is satisfied. The area of the overlapping region 312 of the inner core piece 31 is equivalent to the area $S_{32}$ of the small area portion 321 of the outer core piece 32. The area of the nonoverlapping region 316 of the inner core piece 31 is equivalent to the difference between the area $S_{31}$ and the area $S_{32}$. For this reason, the smaller the area $S_{32}$ of the small area portion 321 is, the larger the area of the nonoverlapping region 316 of the inner core piece 31 can be. As a result, it is possible to increase the size of the space formed by the step portion of the outer core piece 32 and the mold when forming the resin molded portion 6. Forming a larger spaces makes it possible to more easily introduce the mold raw material into the space. Also, the mold raw material can be easily introduced into the openings $g_3$ through the space. Note that the if the area of the nonoverlapping region 316 is too large, the area $S_{32}$ of the small area portion 321 becomes too small, and the amount of flux leakage between the inner core piece 31 and the outer core piece 32 is likely to increase. It is preferable that the area $S_{32}$ of the outer core piece 32 is selected in consideration of facilitating the formation of the resin molded portion 6 and reducing the amount of loss.

Although the area $S_{32}$ of the small area portion 321 of the outer core piece 32 also depends on the constituent material of the inner core pieces 31 and the outer core pieces 32, as one example, it is in a range of greater than or equal to 60% to less than 100% the area $S_{31}$ of the end face 31*e* of the inner core piece 31. Furthermore, the area $S_{32}$ of the small area portion 321 may be approximately greater than or equal to 65%, greater than or equal to 70%, greater than or equal to 75%, or greater than or equal to 80% the area $S_{31}$ of the end face 31*e*. The magnetic path sectional area $S_{322}$ of the large area portion 322 of the outer core piece 32 also depends on the constituent material of the inner core pieces 31 and the outer core pieces 32, as one example, it is in the range of greater than 100% to less than or equal to 200% the area $S_{31}$ of the end face 31*e* of the inner core piece 31. Furthermore, the magnetic path sectional area $S_{322}$ may be approximately less than or equal to 150%, less than or equal to 130%, or less than or equal to 120% the area $S_{31}$ of the end face 31*e*. If this the magnetic path sectional area is in the above-described ranges, the magnetic core 3 is not likely to be too large. The magnetic path sectional area $S_{322}$ of the large area portion 322 can be easily increased by increasing the size of the projection portion 323. For example, the projection portion 323 can be provided such that the lower face of the projection portion 323 is substantially flush with the lower faces of the winding portions 2*a* and 2*b*. In this case, the projection portion 323 efficiently functions as a heat dissipation path from the magnetic core 3 to the installation target, and the heat dissipation performance improves. Also, in this case, the projection portion 323 can be used as a support portion for support to the installation target, and this is excellent in terms of the stability of the installed state of the reactor 1.

The shape of the outer core piece 32 can be changed as desired, within a range according to which the areas $S_{32}$ and $S_{322}$ satisfy the relationship $S_{32}<S_{31}<S_{322}$. As one example, as shown in FIG. 5, the outer core piece 32 includes both a projection portion 323 that projects downward from the base portion 320 and a projection portion 324 that projects upward. In other words, the outer core piece 32 has an inward end face 32*e* that is cross-shaped in a front view. In this case, the surface area of the large area portion 322 can be easily increased even more, and the heat dissipation performance is easily improved. The projection portions 323 and 324 project in directions away from the winding portions 2*a* and 2*b*. For this reason, heat is easily transmitted to a cooling medium or the like, and the heat dissipation performance improves even further. As another example, the outer core piece 32 has a trapezoidal or dome shape in a plan view (top view). In other words, the corner portions of the outer core piece 32 have been subjected to C chamfering or R chamfering to a relatively large extent. Rounding the corner portions make it possible to prevent breakage of the corner portions and to increase the area of contact with the resin molded portion 6.

3.6 Characteristics

In one example, the relative permeability of the outer core piece 32 is higher than the relative permeability of the inner core piece 31. In this case, even if the connecting face 321*e* of the outer core piece 32 is smaller than the end face 31*e* of the inner core piece 31, it is possible to reduce the amount of flux leakage between the inner core piece 31 and the outer core piece 32. In the case where the reactor 1 includes the inner core pieces 31 and the outer core pieces 32 that have different relative permeabilities in this way, it is possible to reduce loss attributed to flux leakage, and a low-loss reactor can be obtained.

The relative permeability referred to here is obtained as follows. A ring-shaped measurement sample (having an outer diameter of 34 mm, an inner diameter of 20 mm, and a thickness of 5 mm) having a composition similar to that of the inner core pieces 31 and the outer core pieces 32 is produced. A winding wire is wound around the measurement sample 300 times on the primary side and 20 times on the secondary side. The B-H initial magnetization curve of the measurement sample with the winding wire is then measured in the range of H=0 (Oe) to 100 (Oe). The highest value of B/H is obtained from the B-H initial magnetization curve and used as the relative permeability. The magnetization curve referred to here is the so-called DC magnetization curve.

If the relative permeability of the outer core piece 32 is higher than the relative permeability of the inner core piece 31, and furthermore the difference between the two relative permeabilities is increasingly large, the more reliably the flux leakage between the inner core piece 31 and the outer core piece 32 can be reduced. In particular, if the relative permeability of the outer core piece 32 is a factor of 2 times or more the relative permeability of the inner core piece 31, it is possible to even more reliably reduce flux leakage. If the difference is even higher, such as the case where the relative permeability of the outer core piece 32 is a factor of 2.5 times or more, 3 times or more, 5 times or more, or 10 times or more the relative permeability of the inner core piece 31, flux leakage can be reduced even more easily. It is preferable to be able to substantially eliminate flux leakage.

The relative permeability of the inner core piece 31 is in the range of 5 to 50 inclusive, for example. The relative permeability of the inner core piece 31 can be reduced to the range of 10 to 45 inclusive, or furthermore to the range of 10 to 40, 35, or 30 inclusive. Magnetic saturation is not likely to occur in the magnetic core 3 if it includes such an inner core piece 31 that has a low permeability. This therefore makes it possible to obtain a gapless-structure magnetic core 3 that does not have a magnetic gap. The gapless-structure magnetic core 3 has substantially no flux leakage that is attributed to a magnetic gap. This therefore facilitates reducing the size of the above-described tubular gap, and makes it possible to obtain a smaller reactor 1. Also, even if the tubular gap is small, the opening $g_3$ is provided. The mold raw material can therefore be more easily introduced into the tubular gap than in the case of the above-described conventional core, and the resin molded portion 6 can be formed easily.

The relative permeability of the outer core piece 32 is in the range of 50 to 500 inclusive, for example. The relative permeability of the outer core piece 32 can raised to 80 or higher, or furthermore 100 or higher (a factor of 2 times the case where the relative permeability of the inner core piece 31 is 50), 150 or higher, or 180 or higher. Such an outer core piece 32 that has a high permeability is likely to have a large difference with the relative permeability of the inner core piece 31. In one example, the relative permeability of the outer core piece 32 can be set to a factor of 2 times or more the relative permeability of the inner core piece 31. In this case, even if the small area portion 321 of the outer core piece 32 is set smaller, it is possible to reduce flux leakage between the inner core piece 31 and the outer core piece 32. The smaller the small area portion 321 is, the larger the nonoverlapping region 316 of the inner core piece 31 can be set. The opening $g_3$ thus increases in size, and the mold raw material can be even more easily introduced into the tubular gap.

3.7 Materials

The inner core pieces 31 and the outer core pieces 32 that constitute the magnetic core 3 are compacts that include a soft magnetic material, for example. One example of the soft magnetic material is a soft magnetic metal such as iron or an iron alloy (e.g., an Fe—Si alloy or an Fe—Ni alloy). Specific examples of core pieces include a resin core piece constituted by a compact of a composite material that includes a magnetic powder and a resin, a compressed powder core piece constituted by a powder compact obtained by compression molding a magnetic powder, a ferrite core piece constituted a sintered body of a soft magnetic material, and a steel plate core piece constituted by a laminated body of stacked soft magnetic metal plates such as magnetic steel plates. Examples of the magnetic powder include a powder made of a soft magnetic material, and a coated powder that further includes an insulating coating. For example, the magnetic core 3 can be a single-type core that includes one type of core piece selected from among the group of a resin core piece, a compressed powder core piece, a ferrite core piece, and a steel plate core piece, or a mixed-type core that includes more than one of the types in the group.

The content amount of the magnetic powder in the composite material that constitutes the resin core piece is in the range of 30 vol % to 80 vol % inclusive, for example. The content amount of the resin in the composite material is in the range of 10 vol % to 70 vol % inclusive, for example. From the viewpoint of improving the saturation magnetic flux density and the heat dissipation performance, the content amount of the magnetic powder can be set to 50 vol % or higher, or furthermore 55 vol % or higher or 60 vol % or higher. From the view of improving fluidity in the manufacturing process, the content amount of the magnetic powder can be set to 75 vol % or lower, or furthermore 70 vol % or lower, and the content amount of the resin can be set higher than 30 vol %.

Examples of the resin in the composite material include a thermosetting resin, a thermoplastic resin, a cold setting resin, and a low temperature setting resin, for example. Examples of the thermosetting resin include an unsaturated polyester resin, an epoxy resin, a urethane resin, and a silicone resin. Examples of the thermoplastic resin include a polyphenylene sulfide (PPS) resin, a polytetrafluoroethylene (PTFE) resin, a liquid crystal polymer (LCP), a polyamide (PA) resin such as nylon 6 or nylon 66, a polybutylene terephthalate (PBT) resin, and an acrylonitrile butadiene styrene (ABS) resin. Other examples include a BMC (Bulk molding compound) in which calcium carbonate or glass fiber is mixed with unsaturated polyester, millable silicone rubber, and millable urethane rubber.

If the above-described composite material contains a non-magnetic and non-metal powder (filler) such as alumina or silica in addition to the magnetic powder and the resin, it is possible to further improve the heat dissipation performance. The content amount of the non-magnetic and non-metal powder is in the range of 0.2 mass % to 20 mass % inclusive, for example. The content amount may furthermore be set to 0.3 mass % to 15 mass % inclusive, or 0.5 mass % to 10 mass % inclusive.

The compact of the composite material can be manufactured by an appropriate molding method such as injection molding or cast molding. If the filling rate of the magnetic powder is be adjusted to a low rate in the manufacturing process, the relative permeability of the resin core piece can be reduced easily. For example, the relative permeability of the resin core piece is in the range of 5 to 50 inclusive. Resin core pieces having different relative permeabilities can be obtained by changing the composition of the magnetic powder as well.

The above-described powder compact is typically obtained by a process in which a mixed powder containing a magnetic powder and a binder is compression molded into a predetermined shape and then subjected to heat treatment after molding, for example. A resin or the like can be used as the binder. The content amount of the binder is approximately 30 vol % or less, for example. When heat treatment is performed, the binder dissipates or becomes a heat-denatured material. A powder compact is likely to contain a higher content amount of the magnetic powder (e.g., over 80 vol %, or 85 vol % or higher) than a compact of a composite material, and makes it easier to obtain a core piece that has a higher saturation magnetic flux density and relative permeability. For example, the relative permeability of the compressed powder core piece is in the range of 50 to 500 inclusive.

The inner core pieces 31 in this example are resin core pieces. The outer core pieces 32 in this example are compressed powder core pieces. Also, the inner core pieces 31 in this example have a relative permeability in the range of 5 to 50 inclusive. The outer core pieces 32 in this example have a relative permeability in the range of 50 to 500 inclusive. Furthermore, the relative permeability of the outer core pieces 32 is a factor of 2 times or more the relative permeability of the inner core pieces 31.

In the case where the inner core piece 31 is a resin core piece, the area $S_{32}$ of the connecting face 321*e* of the outer core piece 32 is greater than or equal to a value obtained by multiplying the area $S_{31}$ of the end face 31*e* of the inner core piece 31 by a filling rate $\alpha$ of the magnetic powder in the inner core piece 31 ($S_{31}\times\alpha$), for example. Here, if the inner core piece 31 is a resin core piece, the magnetic powder located at the end face 31*e* of the inner core piece 31 substantially functions as a magnetic path. In other words, the area $S_{31}$ of the end face 31*e* can be considered to be a magnetic path area. The aforementioned product value ($S_{31}\times\alpha$) can be considered to be the effective magnetic path area. If the area $S_{32}$ of the connecting face 321*e* of the outer core piece 32 is greater than or equal to the product value ($S_{31}\times\alpha$), the connecting face 321*e* has a magnetic path area that is greater than or equal to the effective magnetic path area of the inner core piece 31. For this reason, it is possible to obtain the reactor 1 that can more reliably reduce flux leakage between the inner core piece 31 and the outer core piece 32, while also having predetermined characteristics. The area $S_{32}$ in this example is greater than or equal to the product value ($S_{31}\times\alpha$).

The filling rate $\alpha$ (%) of the magnetic powder in the resin core piece can be, in simple terms, the total area percentage of the magnetic powder in a cross-section of the resin core piece, for example. The total area percentage is obtained as follows, for example. A cross-section of the resin core piece is observed with a microscope. The magnetic powder is extracted from an area S of the cross-section or an area S of a predetermined-sized field of view. A total area Sp of the extracted magnetic powder is then obtained. The total area percentage is then obtained by (Sp/S)×100(%). In strict terms, the magnetic powder is extracted by eliminating the resin and the like in the resin core piece. A volume V of the resin core piece and a volume Vp of the extracted magnetic powder can be used to obtain the filling rate $\alpha=(Vp/V)\times100$ (%), for example.

4. Intermediate Member

The reactor 1 in this example further includes the intermediate members 5 that are disposed between the coil 2 and the magnetic core 3. The intermediate members 5 are typically made of an insulating material, and function as insulating members for insulation between the coil 2 and the magnetic core 3, and positioning members for positioning the inner core pieces 31 and the outer core pieces 32 with respect to the winding portions 2*a* and 2*b*, for example. The intermediate members 5 in this example are rectangular frame-shaped members disposed at the joints between the inner core pieces 31 and the outer core pieces 32 and the vicinity thereof. These intermediate members 5 also function as members that form a flow path for the mold raw material during formation of the resin molded portion 6.

Figure 6:
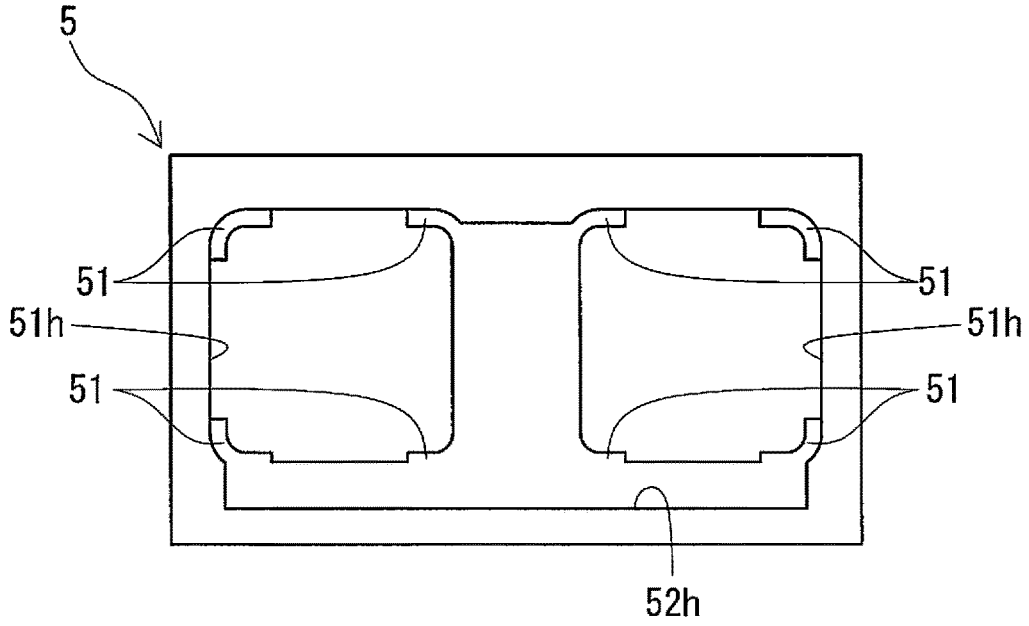
FIG. 6 is a front view of an intermediate member provided in the reactor according to the first embodiment.
Figure 7:
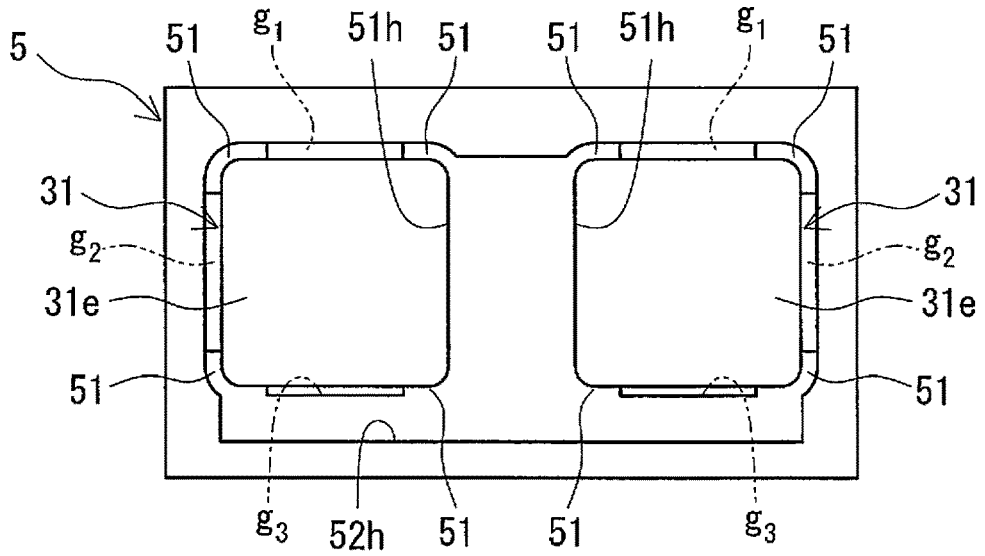
FIG. 7 is a front view of a state where inner core pieces and an intermediate member have been combined in the reactor according to the first embodiment.

The following describes one example of the intermediate members 5 with reference to FIGS. 4, 6, and 7. These three figures are front views in which one intermediate member 5 is viewed from the side where the outer core piece 32 is disposed (hereinafter, called the outer core side). In these three figures, the side on which the winding portions 2*a* and 2*b* are disposed (hereinafter, called the coil side) is on the back side in terms of the paper surface, and cannot be seen. FIG. 4 shows the state where the intermediate member 5 has been combined with the two inner core pieces 31 and one of the outer core pieces 32. FIG. 6 shows the state of only the intermediate member 5. FIG. 7 shows the state where the intermediate member 5 has been combined with the two inner core pieces 31, and the outer core piece 32 has not been disposed.

As shown in FIG. 6, the intermediate member 5 in this example includes two through-holes 51*h*, multiple support portions 51, a coil groove portion (not shown), and a core groove portion 52*h* (see the outward intermediate portion 52 in JP 2017-135334A for an example of a similar shape). The through-holes 51*h* penetrate from the outer core side to the coil side of the intermediate member 5, and are for insertion of the two inner core pieces 31 (see FIG. 7 as well). The inner peripheral faces that form the through-holes 51*h* are substantially continuous with the inner peripheral faces of the winding portions 2*a* and 2*b*. The support portions 51 support portions (four corner portions in this example) of the inner core pieces 31 that partially protrude beyond the inner peripheral faces of the through-holes 51*h* (FIG. 7). The coil groove portion is provided on the coil side of the intermediate member 5. The end faces of the winding portions 2*a* and 2*b* and the vicinity thereof are fitted into the coil groove portion. The core groove portion 52*h* is provided on the outer core side of the intermediate member 5. The inward end faces 32*e* of the outer core pieces 32 and the vicinity thereof are fitted into the core groove portion 52*h* (see FIG. 2 as well). The upper and lower faces of the large area portions 322 of the outer core pieces 32 are supported by the inner peripheral face of the core groove portion 52*h* (FIG. 4).

The winding portions 2*a* and 2*b* are fitted into the coil groove portion, the two inner core pieces 31 are inserted into the through-holes 51*h* (FIG. 7), and the end faces 31*e* respectively abut against the connecting faces 321*e* of the outer core pieces 32 that have been fitted into the core groove portion 52*h*. The shape and size of the intermediate member 5 are adjusted such that flow paths for the mold raw material are provided in this abutting state (FIG. 4). The flow paths for the mold raw material are provided by providing a gap as shown in FIG. 4, for example. Specifically, gaps are provided between the locations where the inner core pieces 31 are not supported by the support portions 51 and the inner peripheral faces of the through-holes 51*h*, and between the outer core pieces 32 and the core groove portion 52*h*, for example. Also, the flow paths for the mold raw material are provided such that the mold raw material does not leak out to the outer peripheral faces of the winding portions 2*a* and 2*b*. The shape, size, and the like of the intermediate member 5 can be selected as desired as long as it has the above-described functions, and known configurations can be used as a reference.

In this example, due to the support portions 51, three openings $g_1$ to $g_3$ are provided between outer peripheral faces of one of the inner core pieces 31 and inner peripheral faces of the through-hole 51*h* through which the inner core piece 31 is inserted. The openings $g_1$ to $g_3$ are formed between inner peripheral edges of the through-hole 51*h* (here, considered to be the inner peripheral edges of the winding portions 2*a* and 2*b*, and this similarly applies below) and the upper edge, the outward edge, and the lower edge of the end face 31*e* of the inner core piece 31, and these openings are not covered by the outer core piece 32. These openings $g_1$ to $g_3$ are used as flow paths for the mold raw material, or particularly introduction openings to the above-described tubular gap.

The constituent material of the intermediate member 5 can be an insulating material such as any of various types of resin, for example. Examples include the various types of thermoplastic resins and thermosetting resins described in the section regarding the composite materials that constitute the resin core pieces. The intermediate member 5 can be manufactured using a known molding method such as injection molding.

5. Resin Molded Portion 5.1 Overview

The resin molded portion 6 has the following functions due to covering outer peripheral faces of at least one core piece provided in the magnetic core 3. Examples of such functions include the function of protecting the core piece from the outside environment, the function of mechanically protecting the core piece, and the function of improving the insulation performance between the core piece and the coil 2 and peripheral components. Moreover, the resin molded portion 6 improves the heat dissipation performance due to exposing the winding portions 2*a* and 2*b* instead of covering the outer peripheral faces thereof. This is because the winding portions 2*a* and 2*b* are allowed to be in direct contact with a cooling medium such as a liquid coolant, for example.

In addition to including the two inner resin portions 61 that cover the outer peripheral faces of the two inner core pieces 31 as shown in FIG. 2, the resin molded portion 6 also includes two end face covering portions 6*e* (end face coverings). The two end face covering portions 6*e* cover the nonoverlapping regions 316 of the end faces 31*e* of the two inner core pieces 31. The resin molded portion 6 in this example further includes two outer resin portions 62 that cover outer peripheral faces of the two outer core pieces 32. Also, the resin molded portion 6 in this example is a single-piece body formed by the inner resin portions 61, the end face covering portions 6*e*, and the outer resin portions 62 that are continuous with each other, and the resin molded portion 6 holds the magnetic core 3 and the intermediate member 5 in a combined and integrated state.

The following describes the inner resin portions 61, the outer resin portions 62, and the end face covering portions 6*e* in this order. The regions of the outer resin portions 62 that cover the step portions of the two outer core pieces 32 are overlapped with the end face covering portions 6*e*, and thus will be described as the end face covering portions 6*e*.

5.2 Inner Resin Portion

The inner resin portions 61 in this example are each a tubular body obtained by filling the above-described tubular gap (here, a quadrangular tube-shaped space) with the constituent resin of the resin molded portion 6. In this example, the inner resin portion 61 has a substantially uniform thickness over the entire length thereof. In the case where the magnetic core 3 has a gapless-structure as in this example, the size of the tubular gap can be reduced. Also, the thickness of the inner resin portion 61 can be reduced in accordance with the size of the tubular gap. The thickness of the inner resin portion 61 can be selected as appropriate. For example, the thickness is in the range of 0.1 mm to 4 mm inclusive. Furthermore, the thickness may be approximately in the range of 0.3 mm to 3 mm, 2.5 mm, 2 mm, or 1.5 mm inclusive.

5.3 Outer Resin Portion

The outer resin portion 62 in this example covers substantially the entirety of the outer peripheral faces of the outer core piece 32, with the exception of the inward end faces 32*e* that are connected to the two inner core pieces 31 and the vicinity thereof. Also, the outer resin portion 62 has a substantially uniform thickness. The region of the outer resin portion 62 that covers the outer core piece 32, as well as the thickness and the like thereof can be selected as appropriate. For example, the thickness of the outer resin portion 62 can be set the same as the thickness of the inner resin portion 61, or set to a different thickness.

5.4 End Face Covering Portion

The end face covering portions 6*e* in this example cover the nonoverlapping regions 316 of the end faces 31*e* of the inner core pieces 31. Also, the end face covering portion 6*e* is formed with a thickness so as to completely cover the step portion of the small area portion 321 and the large area portion 322 of the outer core piece 32. The region of the end face covering portion 6*e* that covers the nonoverlapping region 316, as well as the thickness and the like thereof can be selected as appropriate. In the case of an aspect in which the step portion is completely covered by the end face covering portion 6*e* as in this example, it is possible to ensure that a large space is formed by the step portion and the mold when the resin molded portion 6 is formed. For this reason, the mold raw material can be easily introduced into the space. Also, the mold raw material can be easily introduced into the openings $g_3$ through the space. Note that it is possible to obtain a resin molded portion 6 in which the end face covering portion 6*e* is thin and conforms to the outer shape of the magnetic core 3. However, in the case of including the thick end face covering portion 6*e* that completely covers the step portion as in this example, the mold raw material can be easily introduced into the above-described space, and the resin molded portion 6 can be formed easily.

5.5 Constituent Materials

The constituent material of the resin molded portion 6 can be any of various types of resin, for example. For example, it is possible to use a thermoplastic resin such as a PPS resin, a PTFE resin, LCP, a PA resin, or a PBT resin. If the constituent material is a compound resin that contains any of such resins and any of the previously described fillers that have excellent thermal conductance, it is possible to obtain the resin molded portion 6 that has excellent heat dissipation performance. The constituent resin of the resin molded portion 6 and the constituent resin of the intermediate members 5 may be the same resin. In this case, the bondability between both the resin molded portion 6 and the intermediate member 5 is excellent. Also, the thermal expansion coefficient is the same for both, thus making it possible to suppress peeling, cracking, and the like caused by thermal stress. The resin molded portion 6 can be formed using injection molding or the like.

5.6 Reactor Manufacturing Method

The reactor 1 of the first embodiment can be manufactured as described below, for example. The core pieces that constitute the coil 2 and the magnetic core 3 (here, the two inner core pieces 31 and the two outer core pieces 32) are combined with the intermediate members 5. This assembly is placed in a mold (not shown) for the resin molded portion 6, and the core pieces are covered by the mold raw material.

In this example, the winding portions 2*a* and 2*b* are disposed on the coil sides of the intermediate members 5, the two inner core pieces 31 are inserted into the through-holes 51*h*, and the outer core pieces 32 are disposed on the core sides of the intermediate members 5. The aforementioned assembly can be easily assembled in this way. In the assembly obtained before the formation of the resin molded portion 6, the openings $g_1$ to $g_3$, which are formed by the winding portions 2*a* and 2*b* and the two inner core pieces 31, are exposed through the outer core pieces 32 as described above. Also, the spaces extending from the openings $g_1$ to $g_3$ on one end side of the winding portions 2*a* and 2*b*, through the tubular gaps, and reaching the openings $g_1$ to $g_3$ on the other end side are continuous and not blocked by the two outer core pieces 32. For this reason, the spaces can be favorably used as flow paths for the mold raw material.

The above-described assembly is placed in the mold, and the mold is filled with the mold raw material. This filling can be performed in one direction from one outer core piece 32 to the other outer core piece 32, or in two directions from the outer core pieces 32 toward the inside of the winding portions 2*a* and 2*b*. In both filling methods, the filling of the mold raw material starts at a position corresponding to the outer end face 32*o* of one of the outer core pieces 32. The mold raw material then flows through the outer core piece 32 to the end portions of the winding portions 2*a* and 2*b*. If the mold raw material is supplied to the space formed by the step portions of the outer core piece 32 and the mold, the mold raw material can be introduced to the opening $g_3$ through the space. The mold raw material can also be introduced into the tubular gap through the openings $g_1$ to $g_3$.

5.7 Applications

The reactor 1 of the first embodiment can be used as a part in a circuit for performing voltage step-up or step-down operations, such as a constituent component of any of various types of converters and power conversion apparatuses. Examples of such converters include in-vehicle converters (typically DC-DC converters) for installation in vehicles such as hybrid automobiles, plug-in hybrid automobiles, electric automobiles, and fuel cell automobiles, and converters in air conditioners.

5.8 Effects

In the reactor 1 of the first embodiment, the winding portions 2*a* and 2*b* are exposed and not covered by the resin molded portion 6. For this reason, the winding portions 2*a* and 2*b* can directly come into contact with a cooling medium such as a liquid coolant. This type of reactor 1 has excellent heat dissipation performance. In particular, the reactor 1 includes the uneven-shaped outer core piece 32 that has the small area portions 321 with the magnetic path area $S_{32}$ and the large area portion 322 with the magnetic path sectional area $S_{322}$ ($>S_{32}$). For this reason, the reactor 1 has better heat dissipation performance than in the case where the outer core piece has a uniform magnetic path area $S_{32}$. This is because heat is more easily dissipated from the large area portion 322, and the large area portion 322 easily comes into contact with the aforementioned cooling medium. Due to the provision of the large area portion 322, the heat dissipation performance is even better than in the case of having a larger surface area than that of an outer core piece that has a uniform magnetic path sectional area $S_{31}$.

Also, the reactor 1 of the first embodiment has a portion in which the large area portion 322 protrudes beyond the outer peripheral faces of the inner core pieces 31. Note that this protruding portion is disposed at a position not covering the end faces 31*e* of the inner core pieces 31. Also, the small area portions 321 cover a portion of the end faces 31*e* of the inner core pieces 31, and do not cover the remaining portion. For this reason, the mold raw material can be easily introduced when forming the resin molded portion 6 that covers the magnetic core 3 while also exposing the coil 2. This is because not only the openings $g_1$ and $g_2$, but also the openings $g_3$ formed by the peripheral edges of the nonoverlapping regions 316 of the end faces 31*e* exposed from the outer core piece 32 can be used as openings for introducing the mold raw material. Also, the mold raw material can be easily introduced through these introduction openings (the openings $g_1$ to $g_3$) into the tubular gap between the winding portions 2*a* and 2*b* and the two inner core pieces 31. Accordingly, with the reactor 1 of the first embodiment, the inner resin portions 61 can be formed more easily and precisely than in the case of including the previously described conventional core, and therefore the resin molded portion 6 can be formed easily.

Furthermore, the outer core piece 32 that includes the small area portions 321 and the large area portion 322 has a lighter weight than an outer core piece that has a uniform magnetic path sectional area $S_{322}$. This therefore enables obtaining a lighter-weight reactor 1. The outer core piece 32 in this example is constituted by a powder compact, and is likely to have a higher weight than in the case of a composite material compact of the same volume. However, due to reducing the weight of the outer core piece 32, it is possible to obtain a lighter-weight reactor 1. Additionally, with the reactor 1 of the first embodiment, the insulation performance between the winding portions 2*a* and 2*b* and the two inner core pieces 31 is improved by the inner resin portions 61.

The reactor 1 in this example furthermore has the following effects.

(1) It is possible to obtain a low-loss reactor 1.

This is because the relative permeability of the outer core piece 32 is higher than the relative permeability of the inner core piece 31, thus making it possible to reduce the flux leakage between the inner core piece 31 and the outer core piece 32.

This is also because the overlapping region 312 of the inner core piece 31 includes 50% or more of the inward region, thus making it easier to further reduce flux leakage between the inner core piece 31 and the outer core piece 32.

The area $S_{32}$ of the connecting face 321*e* of the outer core piece 32 is greater than the product value of the area $S_{31}$ of the end face 31*e* of the inner core piece 31 and the filling rate $\alpha$ of the magnetic powder in the composite material ($S_{31}\times\alpha$). For this reason, it is easier to further reduce flux leakage between the inner core piece 31 and the outer core piece 32, thus making the aforementioned effect possible.

The inner core piece 31 is a composite material compact having a relative permeability in the range of 5 to 50 inclusive. The outer core piece 32 is a powder compact having a relative permeability in the range of 50 to 500 inclusive, that is to say a relative permeability that is a factor of 2 times or more the relative permeability of the inner core piece 31. For this reason, it is possible to obtain the gapless-structure magnetic core 3, thus substantially eliminating loss attributed to a magnetic gap, thereby making the aforementioned effect possible.

(2) It is possible to obtain a small-size reactor 1.

Having a gapless structure makes it possible to reduce the size of the previously described tubular gap. The thickness of the inner resin portion 61 can therefore be reduced, thus making the aforementioned effect possible.

The inner core piece 31 is a composite material compact, and the outer core piece 32 is a powder compact. For this reason, the magnetic core 3 can more easily be smaller than in the case of a magnetic core that is constituted by composite material compacts, thus making the aforementioned effect possible.

The outer core piece 32 that has the small area portions 321 can more easily be made smaller than an outer core piece that has a uniform magnetic path sectional area $S_{322}$, thus making the aforementioned effect possible.

Note that even if the tubular gap is small, the openings $g_1$ to $g_3$ can be used as described above, thus making it easier to introduce the mold raw material into the tubular gap. Accordingly, the resin molded portion 6 can be formed easily.

(3) Excellent connection strength is achieved between the inner core pieces 31 and the outer core pieces 32.

This is because fewer core pieces make up the magnetic core 3, and there are fewer joints between the core pieces. Also, the resin molded portion 6 includes the inner resin portions 61 and the outer resin portions 62, which are continuous with each other and formed as a single piece. This therefore improves the rigidity, as an integrated body, of the magnetic core 3 that is covered by the resin molded portion 6, thus making the aforementioned effect possible.

The aforementioned effect is also possible because the connection locations between the inner core pieces 31 and the outer core piece 32 in the resin molded portion 6 include the end face covering portions 6*e* that are thicker than the inner resin portions 61. Even if the inner core piece 31 and the outer core pieces 32 are not connected with use of an adhesive, the magnetic core 3 can be firmly held as a single piece due to the provision of the thick portions.

(4) Corrosion resistance is also excellent due to the inner core pieces 31 being composite material compacts. This is because the composite material contains a resin.

(5) Corrosion resistance is excellent due to the outer core pieces 32 being powder compacts, and due to the outer core pieces 32 being substantially completely covered by the outer resin portions 62.

(6) Fewer core pieces make up the magnetic core 3, and fewer components need to be combined (in this example, a total of seven components include the coil 2, the core pieces, and the intermediate members 5). For this reason, ease of assembly is also excellent.

The present disclosure is indicated by the claims rather than being limited to the foregoing examples, and all changes which come within the meaning and range of equivalency of the claims are intended to be embraced therein.

For example, any one or more of the following changes (a) to (d) can be made to the first embodiment described above.

(a) The reactor includes a self-fusing coil.

In this case, a winding wire that includes a fusing layer is used, and after the winding portions 2*a* and 2*b* are formed, the fusing layer is melted by the application of heat and then allowed to harden, and thus adjacent turns are bonded together by the fusing layer. This enables the winding portions 2*a* and 2*b* to maintain their shape when combining the coil 2 and the magnetic core 3, thus achieving excellent workability.

(b) The reactor includes multiple inner core pieces and a gap portion that is disposed between adjacent inner core pieces.

(c) The outer core piece 32 includes a portion (not shown) that protrudes from the base portion 320 at least one of toward the winding portions 2*a* and 2*b* and away from the winding portions 2*a* and 2*b*, and the outer core piece 32 is T-shaped or cross-shaped in a plan view (top view).

In this case as well, heat is easily dissipated from the large area portion 322, and heat dissipation performance is easily improved.

(d) The reactor includes at least one of the following.

(d1) A sensor (not shown) that measures a physical quantity of the reactor, such as a temperature sensor, a current sensor, a voltage sensor, or a magnetic flux sensor.

(d2) a heat sink (e.g., a metal plate) that is attached to at least one portion of an outer peripheral face of the coil 2.

(d3) A joining layer (an adhesive layer or the like, and preferably a layer that has excellent insulation performance) that is disposed between the installation face of the reactor and the installation target or the heat sink (d2).

(d4) An attachment portion that is integrated with the outer resin portion 62 and is for fixing the reactor to the installation target.

The invention claimed is:

1. A reactor comprising:

a coil having a winding portion;

a magnetic core that is disposed extending inside and outside the winding portion, and is configured to form a closed magnetic circuit; and a resin mold that includes an inner resin disposed between the winding portion and the magnetic core, and does not cover an outer peripheral face of the winding portion, wherein the magnetic core includes an inner core piece disposed inside the winding portion, and an outer core piece that is exposed from the winding portion, the outer core piece includes a small area portion having a connecting face that is connected to an end face of the inner core piece and has a smaller area than the end face, and a large area portion having a magnetic path sectional area that is larger than the area of the end face of the inner core piece, in a view in an axial direction of the winding portion from an outer end face of the outer core piece in a state where the outer core piece has been combined with the inner core piece, the end face of the inner core piece has an overlapping region that is overlapped with the small area portion, and a nonoverlapping region that is not overlapped with both the small area portion and the large area portion, and the resin mold includes an end face covering that covers the nonoverlapping region.

2. The reactor according to claim 1, wherein a relative permeability of the outer core piece is higher than a relative permeability of the inner core piece.

3. The reactor according to claim 1, wherein the inner core piece is formed by a compact made of a composite material that includes a magnetic powder and a resin.

4. The reactor according to claim 3, wherein the area of the connecting face of the outer core piece is greater than or equal to a value obtained by multiplying the area of the end face of the inner core piece by a filling rate of the magnetic powder in the inner core piece.

5. The reactor according to claim 1, wherein:

a relative permeability of the inner core piece is in a range of 5 to 50 inclusive, and a relative permeability of the outer core piece is a factor of 2 times or more the relative permeability of the inner core piece.

6. The reactor according to claim 5, wherein the relative permeability of the outer core piece is in a range of 50 to 500 inclusive.

7. The reactor according to claim 6, wherein the outer core piece is formed by a powder compact.

8. The reactor according to claim 1, wherein:

the coil has a pair of the winding portions that are disposed so as to be laterally adjacent to each other and have parallel axes, the magnetic core has a pair of the inner core pieces that are laterally adjacent to each other and are disposed inside the winding portions, and for each of the inner core pieces, in a case where the end face of the inner core piece is equally divided into two regions in a direction in which the pair of inner core pieces are laterally adjacent to each other, the overlapping region of the inner core piece includes 50% or more of the region on the side closer to the adjacent inner core piece.

* * * * *